US007103999B2

(12) United States Patent
Jones

(10) Patent No.: US 7,103,999 B2
(45) Date of Patent: Sep. 12, 2006

(54) ATTACHMENT CONVERTING SEMI-AUTOMATIC WEAPONS TO RAPID FIRE

(76) Inventor: Emory B. Jones, 2034 Business Loop 181 N., Floresville, TX (US) 78114

( * ) Notice: Subject to any disclaimer, the term of this patent is extended or adjusted under 35 U.S.C. 154(b) by 40 days.

(21) Appl. No.: 10/846,862

(22) Filed: May 14, 2004

(65) Prior Publication Data

US 2005/0268777 A1 Dec. 8, 2005

(51) Int. Cl.
*F41A 19/00* (2006.01)

(52) U.S. Cl. ..... 42/69.01; 42/90; 89/136; 89/27.11; 89/27.3

(58) Field of Classification Search ..... 42/69.01, 42/42.02, 90; 89/136, 27.11, 27.3
See application file for complete search history.

(56) References Cited

U.S. PATENT DOCUMENTS 4,276,808 A 7/1981 York
4,532,852 A 8/1985 Hance
4,685,379 A * 8/1987 Troncoso ..... 89/136
4,787,288 A * 11/1988 Miller ..... 89/27.3
4,803,910 A * 2/1989 Troncoso ..... 89/27.3
6,223,644 B1 5/2001 Troncoso

* cited by examiner

*Primary Examiner*—J. Woodrow Eldred
(74) *Attorney, Agent, or Firm*—G. Turner Moller

(57) ABSTRACT

An attachment for a semi-automatic firearm converts the firearm into a weapon of rapid fire. The attachment includes a crank driving a cam assembly in which the cam is mounted for limited relative movement to the crank. A spring in the attachment acts to bias the cam assembly relative to a follower to a safe non-firing position. The follower is acted on by the cam assembly to manipulate a linkage for pulling a trigger of the firearm in response to rotation of the crank. The follower and cam are designed to minimize the time of maximum movement of the follower thereby maximizing the time allowing the firearm to reset. In one embodiment, a timing mechanism is provided to insure that the bolt of the firearm is in its chambered position before the cam is allowed to actuate the firearm trigger.

18 Claims, 4 Drawing Sheets

ATTACHMENT CONVERTING SEMI-AUTOMATIC WEAPONS TO RAPID FIRE

This invention relates to a device for attachment to a semi-automatic weapon that allows the weapon to be fired in a rapid fire manner.

BACKGROUND OF THE INVENTION

There are weapons enthusiasts who enjoy firing automatic weapons. Automatic weapons not in private hands by a certain date are illegal to own. This has led to two phenomena. First, automatic weapons proven to be in private hands before the critical date are inordinately expensive. Second, many automatic weapons are modified to fire only in a semi-automatic mode for sale to individuals and non-governmental groups.

Because there is a demand for relatively inexpensive rapid fire weapons, there have been proposed and developed a variety of attachments for converting semi-automatic weapons into rapid fire weapons analogous to automatic fire. All of these attachments have their deficiencies. The most serious deficiency, particularly those devices incorporating multilobe cams to actuate the trigger, is that the cams are capable of being stopped at any position in the firing cycle, i.e. from a position where the weapon has just been discharged to a position where the weapon is just about to be discharged again. It can readily be seen that if the cam stops at a position where the weapon is just about to be fired, it is very dangerous because any slight movement of the weapon is capable of discharging a chambered round.

Of relevance to this invention are the disclosures in U.S. Pat. Nos. 4,276,808; 4,532,852 and 6,223,644.

SUMMARY OF THE INVENTION

In this invention, an attachment includes a base secured to the firearm in a suitable location adjacent the trigger. In some firearms, such as a Browning 1919A4 or 1919A6 machine gun converted to semi-automatic fire, the attachment is around the horizontal extension of the pistol grip. In other firearms, the device is placed adjacent or forward of a trigger guard.

The attachment includes a crank having a handle which is rotated by the user and a shaft. The shaft drives a cam assembly through a connection allowing rotation of the cam assembly relative to the shaft through a limited arc. The cam assembly includes a series of cam lobes acting on a follower and a linkage to actuate the firearm trigger each time a cam lobe displaces the follower to its maximum movement. A spring in the attachment resets the cam assembly when rotation of the shaft stops by shifting the cam assembly relative to the shaft. This positions the follower between adjacent cam lobes in a safe non-firing position as opposed to a position on the cam lobe where firing is imminent upon the slightest movement of the firearm or cam lobe.

The crank handle is preferably mounted on the shaft so it couples and decouples from driving engagement with the shaft. This is not only a safety feature but also allows burst firing of the weapon simply by commencing rotation of the crank handle followed by intermittent engagement of the handle and shaft.

A further feature of this invention is the provision of a spring in the attachment causing movement of the attachment components rather than relying on a spring in the firearm to perform any manipulation of the attachment components. Another important feature of this invention is a mechanism for adjusting the linkage or follower thereby changing the position where the linkage first contacts the trigger so the device may be fine tuned for any particular semi-automatic firearm. In other words, if the trigger of a particular firearm requires more, or less, movement of the linkage, this can be easily accommodated. A further feature of this invention is a technique for coupling multiple semi-automatic firearms to fire sequentially in a rapid fire manner. A further feature of this invention is the provision of a timing device which assures that a round is completely chambered before allowing the attachment to advance to a trigger manipulating position.

It is an object of this invention to provide an improved attachment converting a semi-automatic weapon to rapid fire.

A further object of this invention is to provide a rapid fire attachment for a semi-automatic weapon which is substantially safer than prior art devices.

Another object of this invention is to provide a rapid fire attachment for a semi-automatic weapon allowing multiple weapons to be ganged together and fired sequentially.

A more specific object of this invention is to provide a timing device for a rapid fire attachment for a semi-automatic weapon which assures that a round is fully chambered before allowing the attachment to operate.

These and other objects and advantages of this invention will become more apparent as this description proceeds, reference being made to the accompanying drawings and appended claims.

DETAILED DESCRIPTION

Figure 1:
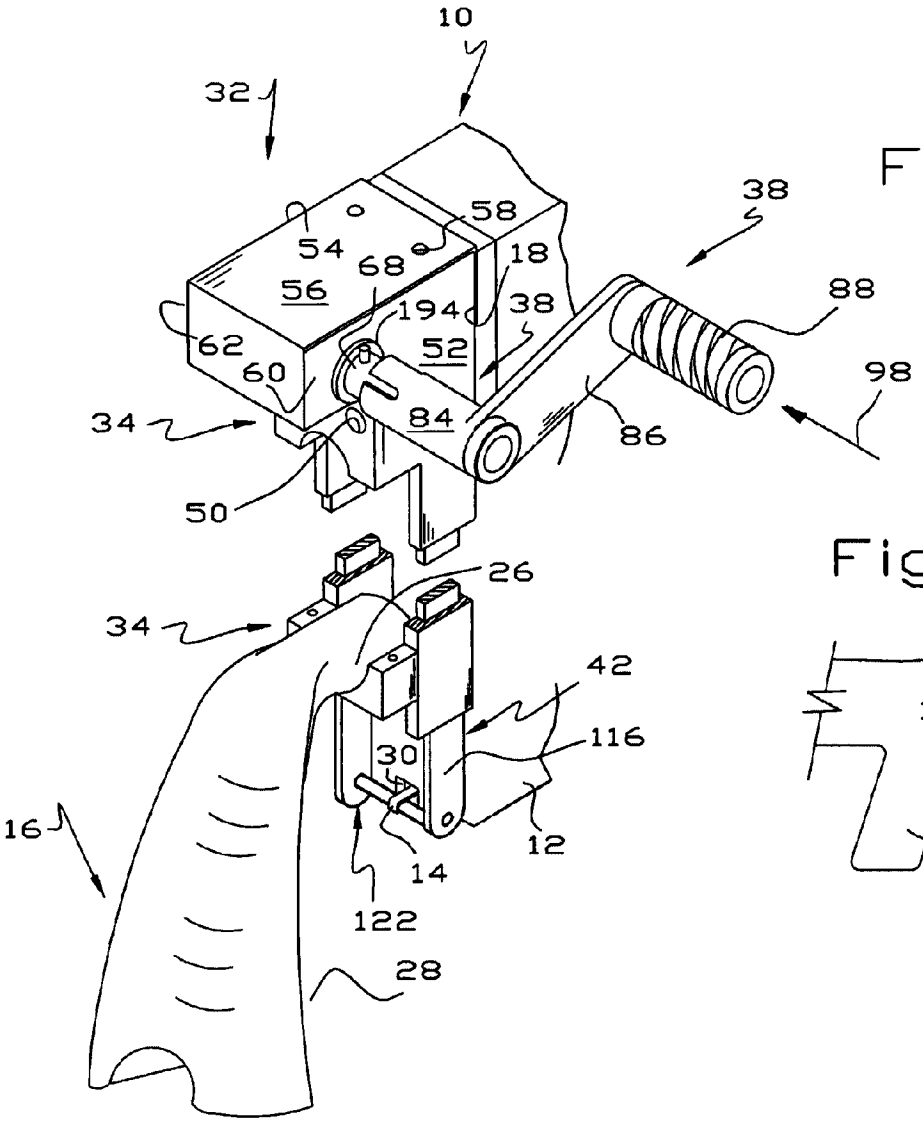
FIG. 1 is an exploded isometric view of a rapid fire attachment of this invention applied to a machine gun converted to semi-automatic fire.
Figure 2:
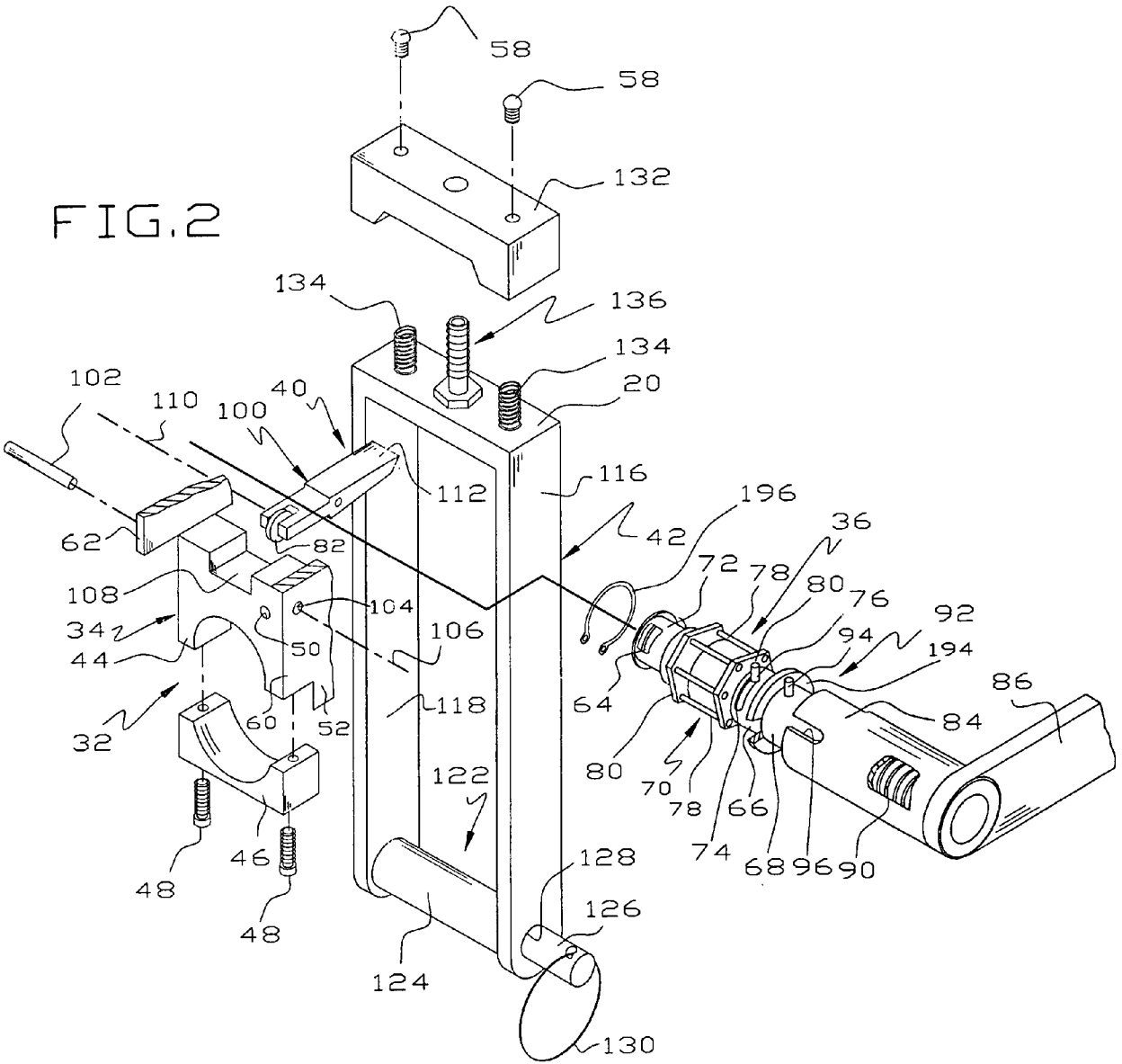
FIG. 2 is an exploded isometric view of the rapid fire attachment of this invention.
Figure 3:
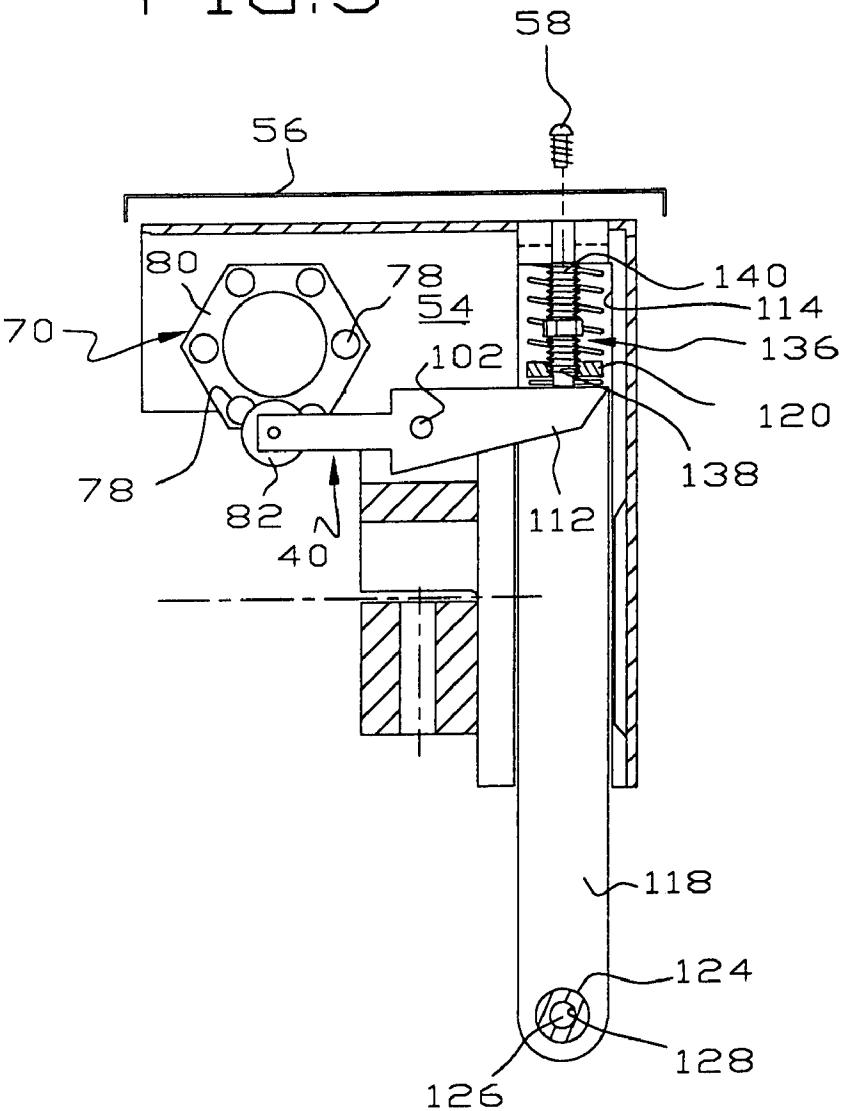
FIG. 3 is a vertical cross-sectional view of the rapid fire attachment of this invention.

Referring to FIGS. 1–3, a weapon or firearm 10 is illustrated to be an automatic that has been modified to fire only in a semi-automatic mode so the weapon 10 is now legal for an individual to own. The weapon 10 may be of any suitable type but is illustrated to be a Model 1919A4 or 1919A6 Browning machine gun which has a characteristic rectangular receiver 12 from which extends a trigger 14. Pulling upwardly on the trigger 14 fires the weapon 10 in a semi-automatic manner, i.e. one round is fired for each pull of the trigger.

A pistol grip 16 attaches to a planar rear face 18 of the receiver 12 in a conventional manner, as by the provision of a dove tail slot (not shown). The pistol grip 16 includes a horizontal extension or tube 26 from which depends a handle or grip 28. A notch 30 in the pistol grip base 24 allows the trigger 14 to extend adjacent the grip 28. Those skilled in the art will recognize FIG. 1 as showing the rear of a Model 1919A4 or 1919A6 Browning machine gun.

In accordance with this invention, an attachment 32 is provided to convert the semi-automatic weapon 10 to rapid fire, analogous to automatic fire. The attachment 32 comprises, as major components, a base 34, a cam assembly 36 driven by a crank handle 38, a follower 40 driven by the cam assembly 36 and a linkage 42 driven by the follower 40 for raising the trigger 14 every time the cam assembly 36 moves the follower 40 to its firing position.

The base 34 secures the attachment 32 to the horizontal extension 26 of the pistol grip 16. The base 34 accordingly includes a pair of generally C-shaped clamp halves 44, 46 secured together around the horizontal extension 26 by one or more fasteners 48. An opening 50 in the upper clamp half 44 aligns with a similar opening in the pistol grip to allow adjustment of the firearm. The base 34 includes a pair of parallel side walls or plates 52, 54 and a cover 56 enclosing the working components of the attachment 32. The cover 56 is removed by unthreading suitable fasteners 58.

The cam assembly 36 is mounted for rotation between forward extensions 60, 62 of the side walls 52, 54. To this end, bearings or sleeves (not shown) may be provided to act between the forward extensions 60, 62 and bearing surfaces 64, 66 on a shaft 68. The cam assembly 36 includes a cam 70 fixed to a sleeve 72 rotatably mounted on the shaft 68. For purposes more fully apparent hereinafter, the arc through which the sleeve 72 is rotatable is limited by an arcuate slot 74 and a pin 76 fixed to the shaft 68. It will accordingly be seen that rotation of the shaft 68 moves the pin 76 into engagement with one end of the slot 74 and thereafter rotates the sleeve 72 along with the shaft 68. It will also be seen that the sleeve 72 is free to rotate away from the pin 76 which is an important feature of this invention.

The cam 70 includes a series of lobes 78 mounted in a circular pattern between end plates 80. An important feature of this invention is that the lobes 78 and the follower 40 are arranged to minimize the dwell that the follower 40 is held in the firing position. Dwell may be measured in degrees of arc or in time. It is important in an attachment to convert semi-automatic fire weapons to rapid fire to minimize the dwell of the cam lobes 78. If the cam lobes 78 hold the follower 40 in its firing position for an unduly long period of time, the attachment will be unable to fire the weapon at its maximum rate of fire. The geometric configuration providing the least amount of dwell is to make both the cooperating parts of cam lobes 78 and the follower 40 of cylindrical configuration. To this end, the follower 40 includes a cylindrical roller 82 cooperating with the cam lobes 78. In this configuration, the cam lobes 78 and the roller 82 act to hold the follower 40 in its position of maximum movement for only a few degrees of arc. This causes the trigger 14 to be pulled and then released in the minimum amount of time which gives the weapon 10 a maximum amount of time to perform its cyclic operation. In other words, by reducing the dwell between the cam lobes 78 and the follower roller 82, the attachment 32 will interfere least with the cyclic operation of the weapon 10. It is evident that the cam lobes 78 need not be completely cylindrical, only that the section operating on the follower roller 82 is preferably cylindrical. Although the cam lobes 78 may be cylindrical and mounted for rotation in order to minimize friction, it has been found this may be desirable but is not necessary.

The shaft 68 is rotated by the crank handle 38. The crank handle 38 includes a sleeve 84 rotatable on the shaft 68 and keyed thereto in any suitable manner (not shown) to prevent the sleeve 84 from coming off the end of the shaft 68. A lever arm 86 connects the sleeve 84 to a handle 88 parallel to the shaft 68. A spring 90 biases the sleeve 84 away from the base 34 of the attachment so a selective drive connection 92 is normally inoperative. The selective drive connection 92 may be of any suitable type but is conveniently a pin-and-slot drive comprising one or more pins 94 fixed to the shaft 68 and one or more slots 96 in the end of the sleeve 84. It will be seen that pushing inwardly on the handle 88 in the direction of the arrow 98 causes the spring 90 to be compressed so the slot 96 passes around the pin 94 thereby transmitting torque between the sleeve 84 and the shaft 68 thereby rotating the shaft 68 in response to rotating the handle 88.

The selective drive connection 92 has important functions in the operation of the attachment 32. First, there is a safety feature because the user has to consciously push the handle 88 inwardly and rotate it to operate the attachment 32 and thereby fire the weapon 10. This is much less likely to occur accidentally than the situation where simple rotation of the handle causes firing. Second, when it is desired to fire a burst from the weapon 10, it is handy to rotate the handle 88 up to speed and then push inwardly momentarily. This causes the weapon 10 to fire a short burst of rounds.

The follower 40 is moved by the cam assembly 36 to manipulate the linkage 42. The follower 40 includes a lever arm 100 mounted by a suitable pin assembly 102 in a passage 104 in the upper clamp half 44 thereby allowing the lever arm 100 to pivot or rotate about an axis 106. A notch 108 in the upper clamp half 44 allows movement of the lever arm 100 in a suitable arc sufficient to actuate the linkage 42 in response to rotation of the cam assembly 36.

The roller 82 of the follower is mounted for rotation about an axis 110 for cooperation with the cam assembly 36 as previously discussed. Another end 112 of the lever arm 100 abuts and manipulates the linkage 42 and thereby manipulates the trigger 14 in response to rotation of the cam assembly 36.

The linkage 42 is manipulated by the follower 40 to pull the trigger 14. The linkage 42 includes a pair of channels or grooves 114 in the inside of the side plates 52, 54, each receiving a rectangular slide 116, 118 connected at the top by a rigid cross-piece 120 and at the bottom by a removable cross-piece 122 which is preferably cylindrical in cross-section. Conveniently, the cross-piece 122 includes a cylindrical sleeve 124 having a pin 126 received therein. The pin 126 is designed to be closely fit in a pair of aligned openings 128. Conveniently, the pin 126 may include a spring biased ball (not shown) holding the pin 126 in place inside the openings 128. A ring 130 may be used to pull the pin 126 out of the slides 116, 118 so the sleeve 124 may be placed under the trigger 14. The pin 126 is placed through the slides 116, 118 and the sleeve 124 to reconnect the sleeve 124 and the slides 116, 118.

A bracket 132 mounted between the side plates 52, 54 above the cross-piece 120 provides an abutment for a pair of springs 134 acting between the bracket 132 and the cross-piece 120 and acting to push the cross-piece 120 downwardly as shown in FIG. 2. Conveniently, the cover fasteners 58 thread into the bracket 132. Downward movement of the cross-piece 120 moves the sleeve 124 away from the trigger 14 allowing the weapon 10 to perform its cycle of operations so that an unfired chambered round will be ready to fire when the attachment 32 again manipulates the trigger 14. The springs 134 are an important part of this invention because they provide the motive power to cycle the attachment 32 so the attachment 32 does not rely on springs inside the weapon 10. In this manner, the attachment 32 is self-powered and does not affect operation of the weapon 10.

Another important feature of this invention is the provision of an adjustment allowing the trigger 14 to be pulled and released by the sleeve 124 in an optimum manner. For example, it is possible that because of manufacturing tolerances of the weapon 10 and manufacturing tolerances of the attachment 32, that the sleeve 124 is positioned in a firing position that is not quite elevated enough to fire the weapon 10. In other words, the sleeve 124 may be positioned too low relative to the trigger 14. Similarly, it is possible that the sleeve 124 may be positioned too high and the trigger 14 is not allowed to move to its non-firing position so the weapon 10 cannot perform its cycle of operations to fire a round. It is accordingly desired to have an adjustment allowing the attachment 32 to accommodate mounting problems of the attachment 32, manufacturing tolerances and other situations where the trigger 14 is not being pulled in an optimum manner.

To these ends, an adjustment is provided between the follower 40 and the linkage 42. The follower end 112 of the follower 40 preferably does not act directly on the cross-piece 120. Instead, the follower end 12 preferably acts on an end of an adjustable abutment 136. The adjustable abutment includes a vertical threaded passage 138 in the cross-piece 120 and a threaded rod 140 in the passage 138. A nut 142 is tightened against the cross-piece 120 to prevent unthreadinq movement of the rod 140 thereby preventing the abutment 136 from moving out of position.

Installation of the attachment 32 should now be apparent. With the fasteners 48 out and the lower cross-piece 122 disassembled, the clamp halves 44, 46 are placed around the horizontal section 26 in a position where the slides 116, 118 straddle the horizontal section. The lower cross-piece 122 is reinstalled between the slides 116, 118 under the trigger 14. The lower clamp half 46 is abutted against the upper clamp half 44 and attached by the fasteners 48. The abutment 136 is adjusted until upward movement of the slides 116, 118 is sufficient to pull the trigger 14 and allow the trigger 14 to move to its normal non-firing position when the slides 116, 118 are in a lowermost position.

Operation of the attachment 32 should now be apparent. With the weapon 10 loaded with ammunition, the handle 88 is rotated while pushing in toward the attachment 32 to engage the selective drive connection 92. This causes the pin-and-slot drive to rotate the shaft 68 thereby advancing the pin 76 to the end of the slot 74 and thereby rotate the sleeve 72 and cam 70. As one of the cam lobes 78 passes the follower roller 82, the roller 82 is depressed causing the follower lever arm 100 to pivot on its axis 106 thereby pushing the linkage 42 upwardly against the force of the springs 134. As the cam lobe 78 passes by the follower roller 82, the linkage 42 is raised, thereby raising the trigger 14 and firing the weapon 10.

When the user stops cranking on the handle 88, rotation of the shaft 68 stops. It will be seen that the sleeve 72 is free to rotate in the limited arc provided by the slot 74 and the force applied by the springs 134 act through the follower 40 and roller 82. For these reasons, the cam 70 and sleeve 72 are free to rotate away from the pin 74 and thereby move the follower roller 82 into the depression between adjacent cam lobes 78. It will also be seen that each cam lobe 78 provides a ramp leading upwardly toward the firing position of the weapon 10 and a ramp leading downwardly away from the firing position.

From a standpoint of safety, it is important to move the cam 70 away from the firing position because of the operation of the weapon 10 and the operation of the attachment 32. Independent of the attachment 32, after the weapon 10 is discharged, its cycle of operation will eject the cartridge case in the chamber, reset the sear and rechamber an unfired round and thereby ready the weapon 10 for a subsequent firing. It is accordingly important that the attachment 32 position itself in a safe, non-firing position, preferably in a position between cam lobes and ideally in a position more-or-less equidistant between cam lobes, particularly if the attachment 32 operates in either direction of rotation of the cam 70 which the device of FIG. 1–3 does. Thus, the springs 134 and the roller 82 act on the cam lobes 78 to shift the cam 70 and sleeve 72 so the roller 82 comes to rest between adjacent cam lobes 78, i.e. generally off the first ramp leading up to the firing position and generally off the second ramp leading away from the firing position.

An important aspect of this safety feature is the arc distance of the slot 74. The amount of rotation allowed the sleeve 72 is a function of the number of cam lobes 78 on the cam 70 and is slightly greater than the spacing between adjacent lobes. On a cam having six lobes, there is a 60° arc between cam lobes so the slot 74 is preferably slightly greater than 60°, for example 70°. Preferably, the center of the slot 74 is at about the same radial position as one of the cam lobes 78. This allows the cam assembly 36 to be made without requiring extensive and exact positioning of the slot 74 and cam lobes 78.

Figure 4:
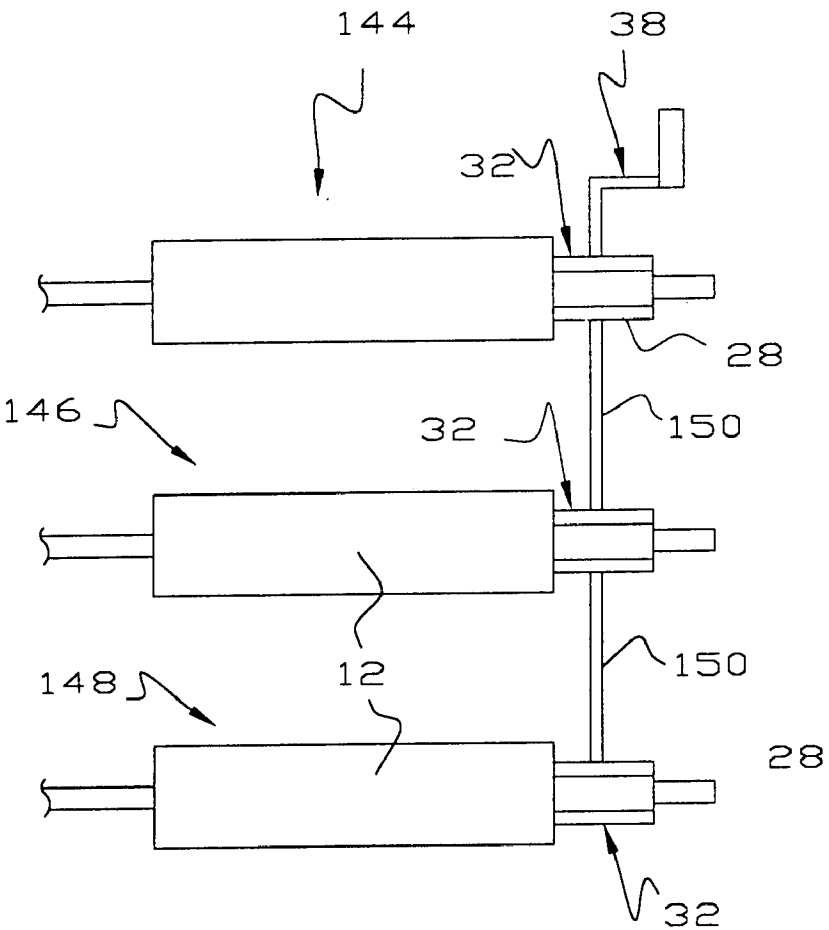
FIG. 4 is a schematic view of multiple weapons fired together with attachments of this invention.

Referring to FIG. 4, there is illustrated three semi-automatic weapons 144, 146, 148 each equipped with an attachment 32 of this invention. The crank handles 38 of the two left weapons have been removed and a Bowden wire, which is basically a speedometer cable, or other flexible connector 150 used to connect the shaft 68 of each attachment 32 to its adjacent weapon. Thus, rotating the handle 38 of the right-most attachment 32 causes each weapon 144, 146, 148 to fire. In this situation, it is much preferred that the cam lobes 78 be staggered so the weapons fire sequentially rather than simultaneously.

Figure 5:
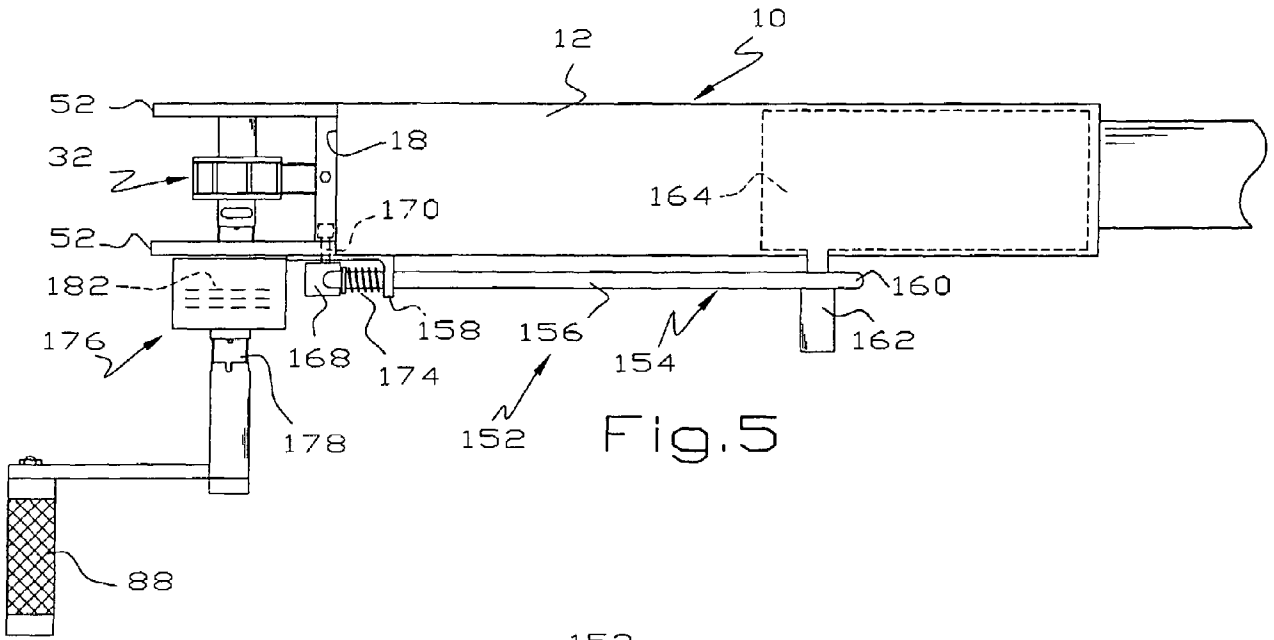
FIG. 5 is a top view of a weapon, attachment and timing device of this invention, the cover of the attachment being removed for clarity of illustration.
Figure 6:
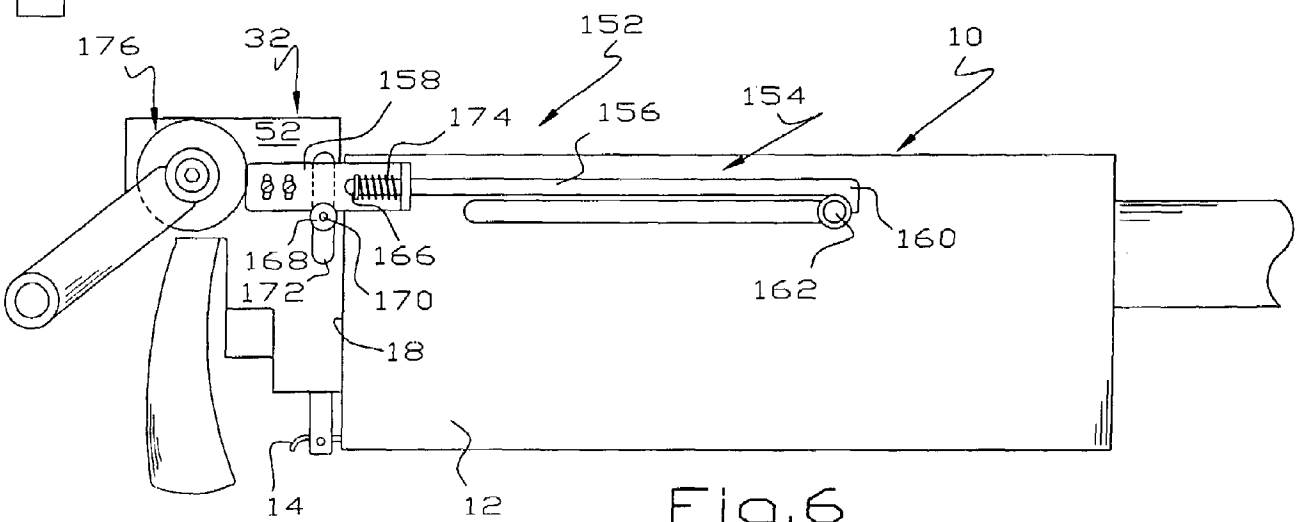
FIG. 6 is a side view of the device of FIG. 5.

Referring to FIGS. 5 and 6, another feature of this invention is illustrated. It is possible that the user of an attachment 32 may be able to rotate the handle 88 so fast that the cyclic operation of the weapon 10 cannot keep up. In other words, it may be possible to turn the cam 70 faster than the cyclic rate of operation of the weapon 10. In order to prevent the weapon 10 from stalling due to overrunning of the cam 70, a timing device 152 is provided. The timing device 152 cooperates with a modified attachment 32 to assure that the cam 70 does not rotate to a firing position until a round is fully chambered in the weapon 10.

To this end, the timing device 152 comprises a slide assembly 154 mounted on the side of the weapon 10 having a long rod 156 mounted for reciprocating movement by a bracket 158 mounted on the attachment 32. The rod 156 provides a hooked end 160 or other suitable connection to a handle 162 of a bolt 164 of the weapon 10. The opposite end of the rod 156 provides an inclined face 166 cooperating with a roller or other actuator 168.

The attachment 32 is modified in two respects to cooperate with the timing device 152. First, the actuator 168 connects to the linkage 42 because a stem 170 of the actuator 168 extends through a slot 172 in the side wall 52 as shown in FIG. 6. Thus, if the bolt 164 is not fully forward, meaning that a round is not fully chambered, the face 166 of the rod 156 prevents the trigger 14 from being pulled upwardly, meaning that the weapon 10 will not fire. When the bolt 164 has moved to its forewardmost position, the rod 156 moves sufficiently forward to pull the slide 154 forwardly so the face 166 is forward of the actuator 168. This allows the actuator 168 and the linkage 42 to move vertically to raise the trigger 14 and thereby discharge the weapon 10. A spring 174 biases the rod 156 rearwardly, so the normal position of the rod 156 is in a position blocking firing of the weapon 10.

Some mechanism is needed to prevent the attachment 32 from jamming when the linkage 42 is prevented from moving upwardly. To this end, a clutch assembly 176 is provided. The clutch assembly 176 has the characteristic of allowing its input member 178 to rotate when its output member 180 is temporarily stalled and, when the output member 180 is no longer stalled, immediately drives the output member 180. Although any suitable clutch having this characteristic is suitable for use with the timing device 152 of this invention, a preferred clutch incorporates a series of clutch plates 182 which selectively transmit torque and resist torque transmission. One such preferred clutch is made by Rino Mechanical Components of Freeport, N.Y. and is known as Part Number 579.25.2727U. It will accordingly be seen that the user cannot turn the crank handle 88 too fast because if the attachment 32 begins to outrun the cyclic rate of fire of the weapon 10, the timing device 154 prevents the linkage 42 from moving upwardly thereby momentarily preventing the weapon 10 from firing. When the bolt 164 moves to a fully chambered position, the linkage 42 is free to move and the clutch 176 then transmits torque to the cam assembly 36 thereby firing the weapon 10 as if nothing had happened. Because of the clutch assembly 176, the user is not normally aware that the crank handle 88 has been turned so fast as to outrun the weapon 10.

Figure 7:
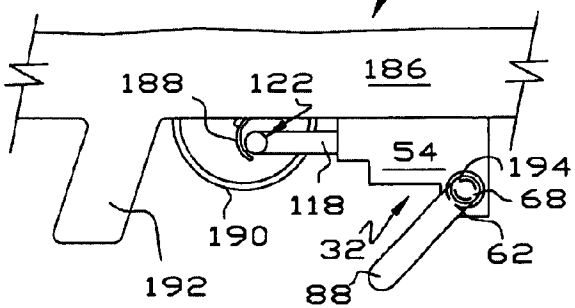
FIG. 7 is a side view of the attachment of this invention being connected to a different style semi-automatic firearm.

As is apparent, the principles of the attachment 32 of this invention are usable in conjunction with other semi-automatic weapons. For many semi-automatic weapons that require triggers to be pulled horizontally rather than vertically lifted, the attachment 32 can be used with no substantial modification simply by mounting the attachment adjacent the trigger guard and having the slides 116, 118 straddle the trigger guard. Referring to FIG. 7, this application is illustrated in connection with an MG-34 or MG-42 weapon 184. Those skilled in the art will recognize these firearms to be World War II vintage machine guns of the German Army.

The weapon 184 accordingly includes a receiver 186 having a downwardly projecting trigger 188 partly surrounded by a trigger guard 190 and a pistol grip 192 rearward of the trigger 188. The attachment 32 is mounted forwardly of the trigger guard 190 with the linkage slides 116, 118 straddling the trigger guard 190 and the cross-piece 122 adjacent the trigger 188. An important feature of this invention is that the cam assembly 36 is outside the trigger guard 190. This allows the cam assembly 36 to provide a large number of cam lobes 78 as compared to the situation where the cam assembly resides inside the trigger guard. All previously known rapid fire attachments provide the cam lobes inside the trigger guard, meaning there is no room for more than about four cam lobes and meaning that the crank handle has to be turned very rapidly to match the cyclic rate of fire of many converted automatic weapons. In this invention, there are preferably at least six cam lobes and, by mounting the cam assembly 36 outside the trigger guard 188, there is space for any reasonable number cam lobes 78, meaning that the attachment of this invention can be turned fast enough to match the cyclic rate of fire of almost any firearm.

A comparison of FIGS. 1 and 7 illustrates another feature of this invention. FIG. 1 shows the shaft 68 exiting through the extension 60 of the side wall 52. FIG. 7 shows the crank handle 88 and shaft 68 exiting through the extension 62 of the side wall 54. The shaft 68 and cam assembly 36 are accordingly reversible in the passages through the side walls 52, 54. This is accomplished by providing a boss 194 fixed to the shaft 68 intermediate the ends thereof and a removable keeper 196 on the end of the shaft 68. This has the beneficial side effect of allowing the attachment 32 to be either left or right handed, meaning that the attachment 32 can be assembled with the crank handle 88 turned either by the user's left or right hand.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. An attachment for converting a semi-automatic firearm into rapid fire comprising a base for attachment to the firearm, a shaft carried by the base, a crank having a handle for rotating the shaft, a cam, including at least two cam lobes separated by a depression, mounted for rotation independently of the shaft for a limited arc and driven by the shaft upon rotation of the crank, and a spring operating between the cam and the shaft for rotating the cam, a follower for abutting the cam lobes, and a linkage driven by the follower to actuate a trigger of the firearm when the cam lobes move the follower, the cam being moved by the spring upon release of the crank handle so the follower is disposed in the depression between the cam lobes upon release of the crank handle.

2. The attachment of claim 1 wherein the cam assembly is rotatable on the shaft.

3. The attachment of claim 1 wherein each cam lobe provides a first ramp for moving the follower toward a firing position and a second ramp allowing the follower to move away from the firing position, the follower being prevented from stopping on the first ramp when the crank handle is released and quits turning the shaft.

4. The attachment of claim 1 wherein the shaft includes a drive connection driving the cam upon rotation of the crank handle in one rotational direction and the spring biases the cam relative to the shaft in an opposite rotational direction.

5. The attachment of claim 1 wherein the cam lobes are radially spaced apart by a predetermined arc, the limited arc being greater than the predetermined arc.

6. An attachment for converting a semi-automatic firearm into rapid fire comprising a base for attachment to the firearm, a shaft carried by the base, a crank handle for rotating the shaft, a cam on the shaft, a follower abutting the cam and a linkage driven by the follower to actuate a trigger of the firearm when the cam moves the follower, the cam providing a cam lobe having a circular section for abutting the follower and the follower having a circular section for abutting the cam lobe thereby providing a minimum dwell when the cam moves the follower thereby increasing the time allowing the firearm to reset in preparation for firing a subsequent round.

7. The attachment of claim 6 wherein at least one of the cam lobe and the follower includes a circular roller.

8. The attachment of claim 6 wherein the follower comprises a circular roller for abutting the cam lobe.

9. The attachment of claim 8 wherein the cam comprises a circular base having a series of equally spaced cylindrical lobes about a circumference of the base.

10. An attachment for converting a semi-automatic firearm into rapid fire comprising a base for attachment to the firearm, a shaft carried by the base and having a driven component, a crank including a driving component and a handle and an interruptible coupling connecting the driving component to the driven component for selectively rotating the shaft, a spring biasing the driven component away from driving engagement with the driving component, a cam on the shaft, a follower abutting the cam and a linkage driven by the follower to actuate a trigger of the firearm when the cam moves the follower, the interruptible coupling providing a safety feature whereby rotation of the cam stops when a user releases the crank handle.

11. An attachment for converting a semi-automatic firearm into rapid fire comprising a base for attachment to the firearm, a cam assembly including a shaft carried by the base and at least one cam lobe, a crank for rotating the shaft, a follower for abutting the cam lobe and a linkage driven by the follower in a path of movement to actuate a trigger of the firearm when the cam lobe moves the follower, the linkage being adjustable, in a direction of the path of movement, relative to the base and relative to the trigger, the follower abutting the linkage at a location and the adjustable linkage comprises an adjustable shoulder movement of which changes the location where the follower abuts the linkage.

12. An attachment for converting a semi-automatic firearm into rapid fire comprising a base for attachment to the firearm, a cam assembly including a shaft carried by the base and at least two cam lobes separated by a depression, a crank for rotating the shaft, a follower for abutting the cam lobes, a linkage driven by the follower to actuate a trigger of the firearm when the cam lobes move the follower, and a spring biasing the linkage away from the trigger so that the cam lobes move the linkage to a firing position and the spring moves the linkage away from the trigger allowing the firearm to reset in preparation of firing a subsequent round.

13. The attachment of claim 12 wherein the cam assembly and follower being arranged to move the cam assembly so the follower is disposed in the depression between cam lobes upon release of the crank handle, the spring providing the motive force for moving the cam assembly.

14. An attachment for converting a semi-automatic firearm into rapid fire, the firearm having a reciprocating slide movable between a firing position in which a round is fully chambered in the firearm and a position allowing an extracted round to be ejected, the attachment comprising a base for attachment to the firearm, a cam assembly including a shaft carried by the base and at least one cam lobe, a crank for rotating the shaft, a follower for abutting the cam lobe, a linkage driven by the follower in a path of movement to actuate a trigger of the firearm when the cam lobe moves the follower and a timing device for engaging the slide and preventing movement of the cam lobe to a firing position until the slide is in the firing position.

15. The attachment of claim 14 further comprising a clutch between the crank and the cam assembly allowing the crank to overrun the cam assembly until the timing device allows movement of the cam lobe to the firing position.

16. The attachment of claim 15 wherein the timing device includes a reciprocating rod having one end for attachment to the slide and a second end, the rod being mounted for movement between a first position preventing movement of the cam lobe to the firing position and abutting the linkage to a second position spaced from the linkage allowing the linkage, follower and cam assembly to move.

17. A semi-automatic firearm comprising a housing having a trigger projecting therefrom, a trigger guard around the trigger and providing an enclosed space between the trigger guard and the housing, and an attachment converting the firearm to rapid fire comprising a base for attachment to the firearm adjacent the trigger, a cam assembly including a shaft carried by the base and a multiplicity of cam lobes, a crank for rotating the shaft, a follower for abutting the cam lobe, the cam assembly, shaft and follower being located at a position outside the enclosed space and thereby being spaced from the trigger and trigger guard, and a linkage extending from the follower to adjacent the trigger, the linkage being driven by the follower in a path of movement to actuate a trigger of the firearm when the cam lobe moves the follower.

18. The attachment of claim 17 wherein there are at least six cam lobes.

* * * * *